US007324773B2

(12) United States Patent
Sugiyama

(10) Patent No.: US 7,324,773 B2
(45) Date of Patent: Jan. 29, 2008

(54) IMAGE FORMING DEVICE HAVING A POWER CONSUMPTION CONTROL DEVICE CONTROLLING POWER SUPPLIED TO A FIXING DEVICE

(75) Inventor: Tsukasa Sugiyama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 233 days.

(21) Appl. No.: 11/258,887

(22) Filed: Oct. 27, 2005

(65) Prior Publication Data

US 2007/0098431 A1 May 3, 2007

(51) Int. Cl.
*G03G 15/00* (2006.01)
*G03G 15/20* (2006.01)

(52) U.S. Cl. ..... 399/88; 399/37; 399/45; 399/67; 399/70

(58) Field of Classification Search ..... 399/88, 399/33, 37, 67, 69, 70, 45, 43, 320; 219/216; 347/156

See application file for complete search history.

(56) References Cited

U.S. PATENT DOCUMENTS

| | | | | |
|---|---|---|---|---|
| 6,753,973 | B2 * | 6/2004 | Hashimoto et al. | 399/37 X |
| 7,120,371 | B2 * | 10/2006 | Fujimori | 399/67 |
| 2002/0071688 | A1 * | 6/2002 | Maruyama | 399/45 |
| 2005/0191076 | A1 * | 9/2005 | Dan | 399/70 |

* cited by examiner

*Primary Examiner*—Sophia S. Chen
(74) *Attorney, Agent, or Firm*—Global IP Counselors, LLP

(57) ABSTRACT

A sheet counter counts points corresponding to the number of sheets subjected to a fixing process performed by a fixing unit during the image forming operation (during the copy state). A heater actuation time counter counts points corresponding to the heater actuation time (ON time) when a fixing operation is performed by a fixing unit during the image forming operation (during the copy state). When power consumption is high, a fixing control temperature can be set so as to reduce the power consumption during the non-image forming operating time (standby state and preheat state) by determining the power consumption (of the fixing unit) during the image forming operation based on the points counted by a sheet counter during one week, or points counted by a heater actuation time counter during one week.

7 Claims, 4 Drawing Sheets

| Paper size | Paper type | Copy No. | Surface ratio | Wt. ratio | Points |
|---|---|---|---|---|---|
| A3 | normal | 150 | 2.0 | 1.0 | 300 |
| B4 | normal | 20 | 1.7 | 1.0 | 34 |
| A4 | normal | 1350 | 1.0 | 1.0 | 1350 |
| | OHP | 55 | 1.0 | 1.5 | 82.5 |
| | normal | 70 | 1.0 | 0.5 | 35 |
| B5 | normal | 530 | 0.7 | 1.0 | 371 |
| | OHP | 10 | 0.7 | 1.5 | 10.5 |
| A5 | normal | 30 | 0.5 | 1.0 | 15 |
| | | | | total | 2198 |

Fig. 6

| Points | Preheat temp. | | Standby temp. |
|---|---|---|---|
| | Energy save priority | Recovery time priority | |
| 0～1000 | 155℃ | 155℃ | 165℃ |
| 1001～2000 | 150℃ | 155℃ | 163℃ |
| 2001～3000 | 145℃ | 155℃ | 161℃ |
| 3001～4000 | 140℃ | 155℃ | 159℃ |
| 4001 or more | 135℃ | 155℃ | 157℃ |

Fig. 7

| Points | Preheat temp. | | Standby temp. |
|---|---|---|---|
| | Energy save priority | Recovery time priority | |
| 0～1650 | 155℃ | 155℃ | 165℃ |
| 1651～3300 | 150℃ | 155℃ | 163℃ |
| 3301～4950 | 145℃ | 155℃ | 161℃ |
| 4951～6600 | 140℃ | 155℃ | 159℃ |
| 6601 or more | 135℃ | 155℃ | 157℃ |

Fig. 8A

| Preheat temp. | Heater ON/OFF | Energy save ratio |
|---|---|---|
| 155℃ | 10:5 | 0. 0 (standard) |
| 150℃ | 10:6 | 4. 2 |
| 145℃ | 10:7 | 7. 9 |
| 140℃ | 10:8 | 11. 1 |
| 135℃ | 10:9 | 14. 1 |

Fig. 8B

| Standby temp. | Heater ON/OFF | Energy save ratio |
|---|---|---|
| 165℃ | 10:2 | 0. 0 (standard) |
| 163℃ | 10:2. 5 | 3. 3 |
| 161℃ | 10:3 | 6. 4 |
| 159℃ | 10:3. 5 | 9. 2 |
| 157℃ | 10:4 | 11. 9 |

IMAGE FORMING DEVICE HAVING A POWER CONSUMPTION CONTROL DEVICE CONTROLLING POWER SUPPLIED TO A FIXING DEVICE

FIELD OF THE INVENTION

The present invention relates to an image forming device, such as a copying machine or the like.

BACKGROUND INFORMATION

Image forming devices are capable of forming images on paper by transferring a toner image onto the paper, and fixing the transferred toner image onto the paper by means of a heating process performed by a fixing unit. The fixing unit is provided with, for example, a heating roller (fixing roller), and a pressure roller. The heating roller and pressure roller abut one another such that the surfaces of the rollers are in mutual contact at a predetermined pressure, and at least one roller (for example, the heating roller) is heated by a heater. According to this configuration, a paper sheet bearing a transferred toner image is subjected to a fixing process, such as a heating process, pressure process and the like, as the sheet passes between the heating roller and pressure roller, so as to fix the transferred toner image onto the paper.

During the image formation operation, the fixing process heating process) can be satisfactorily performed by actuating the heater such that the temperature of the heating roller reaches a predetermined fixing temperature (for example, 170° C.). At times other than during the image formation process, that is, when the operation of forming an image on paper is not being performed (operation of the toner image transfer process, operation of the fixing process and the like), the drive current supplied to the heater is reduced and the temperature of the heating roller is reduced to a predetermined temperature (for example, 135~165° C.) that is less than the fixing temperature. In this way the power consumption of the fixing unit (heater) can be reduced, and the temperature of the heating roller can be raised to the fixing temperature in a short time when the image forming operation begins.

When a relatively large size paper sheet is used (for example, A3 or B4 sizes), and when a relatively thick (high weight ratio) sheet is used (for example, OHP sheet), the heater has a longer actuation time, and the power consumption of the fixing unit is increased due to the large amount of heat imparted to the sheet by the heating process performed by the fixing unit. When a relatively small size paper sheet is used (for example, B5 or A5 sizes), and when a relatively thin (low weight ratio) sheet is used (for example, tracing paper and the like), the heater has a shorter actuation time, and the power consumption of the fixing unit is reduced due to the small of heat imparted to the sheet by the heating process performed by the fixing unit.

Accordingly, when an image forming operation is performed using only relatively thick (high weight ratio) sheets or relatively large size sheets within a predetermined time period, the power consumption of the fixing unit increases and the power consumption of the entire image forming device increases within the predetermined time period.

Based on this background, an object of the present invention is to provide an image forming device capable of suppressing an increase in power consumption.

SUMMARY OF THE INVENTION

An invention according to a first aspect achieves these objects in an image forming device (1) capable of forming an image on paper by transferring a toner image onto the paper, and fixing the transferred toner image onto the paper by means of a heating process performed by a fixing unit (9), the image forming device having integrating means (18, 19) for integrating values corresponding to the power consumed during an image forming operation; and power consumption control means (15, S8, S9) for controlling the power consumption at times other than during the image formation processing in accordance with the values integrated by the integrating means within a predetermined time period.

The numbers in parentheses represent corresponding structural elements in the embodiments described later. This convention remains true throughout the description.

According to this configuration, power consumption during the image forming operation within a predetermined time period is determined based on the values integrated by the integrating means, and when power consumption is high, the increase in the power consumption of the entire image forming device is controlled so as to minimize the power consumption at times other than during the image formation processing.

An invention according to a second aspect is the image forming device (1) of the first aspect, wherein the integrating means (18, 19) integrates values corresponding to the amount of heat imparted to a sheet when a heating process is performed by the fixing unit (9); and the power consumption control means (15, S8, S9) controls the power consumption of the fixing unit at times other than during the image formation process in accordance with the values integrated by the integrating means within a predetermined time period.

According to this configuration, power consumption by the fixing unit during the image forming operation within a predetermined time period is determined based on the integrated value of the values corresponding to the amount of heat imparted to the sheet subjected to the heating process performed by the fixing unit, and when power consumption is high, the increase in the power consumption of the entire image forming device is controlled so as to minimize the power consumption of the fixing unit at times other than during the image formation processing.

An invention according to a third aspect is the image forming device (1) of the first aspect, wherein the integrating means (18, 19) has a sheet number integrating means (18) for integrating values corresponding to the number of sheets subjected to the heating process performed by the fixing unit.

A large amount of heat is imparted to the sheets undergoing the heating process performed by the fixing unit when a relatively large number of sheets are subjected to the heating process performed by the fixing unit, and a small amount of heat is imparted to the sheets undergoing the heating process performed by the fixing unit when a relatively small number of sheets are subjected to the heating process performed by the fixing unit.

According to this configuration, power consumption by the fixing unit during the image forming operation within a predetermined time period is determined based on the integrated value of the values corresponding to the number of sheets subjected to the heating process performed by the fixing unit, and when power consumption is high, the increase in the power consumption of the entire image forming device is controlled so as to minimize the power consumption of the fixing unit at times other than during the image formation processing.

An invention according to a fourth aspect is the image forming apparatus (I) of the third aspect having a means for changing the value integrated by the sheet number integrating means (18) in accordance with the surface area of the sheet subjected to the heating process performed by the fixing unit (9).

A large amount of heat is imparted to the sheet subjected to the heating process performed by the fixing unit when the sheet has a relatively large surface area (size), and a small amount of heat is imparted to the sheet subjected to the heating process performed by the fixing unit when the sheet has a relatively small surface area (size).

According to this configuration, power consumption by the fixing unit during the image forming operation within a predetermined time period is determined based on the integrated value of the values corresponding to the surface area of sheets subjected to the heating process performed by the fixing unit.

An invention according to a fifth aspect is the image forming apparatus of the third aspect having a means for changing the value integrated by the sheet number integrating means (18) in accordance with the type of the sheet subjected to the heating process performed by the fixing unit (9).

A large amount of heat is imparted to the sheet subjected to the heating process performed by the fixing unit when the sheet is relatively thick (high weight ratio), and a small amount of heat is imparted to the sheet subjected to the heating process performed by the fixing unit when the sheet is relatively thin (low weight ratio).

According to this configuration, power consumption by the fixing unit during the image forming operation within a predetermined time period is accurately determined based on the integrated value of the values corresponding to the type of sheets subjected to the heating process performed by the fixing unit.

An invention according to a sixth aspect is the image forming apparatus of the second aspect, wherein the fixing unit (9) has a heater (12) actuated for a heating process; and the integrating means (18, 19) has a heater actuation time integrating means for integrating values corresponding to the heater actuation time when a heating process is performed by the fixing unit.

A large amount of heat is imparted to the sheet subjected to the heating process performed by the fixing unit when the heater is actuated for a relatively long time while the heating process is performed by the fixing unit, and a small amount of heat is imparted to the sheet subjected to the heating process performed by the fixing unit when the heater is actuated for a relatively short time while the heating process is performed by the fixing unit.

According to this configuration, power consumption by the fixing unit during the image forming operation within a predetermined time period is determined based on the integrated value of the values corresponding to the heater actuation time while the heating process is performed by the fixing unit, and when power consumption is high, the increase in the power consumption of the entire image forming device is controlled so as to minimize the power consumption of the fixing unit at times other than during the image formation processing.

BRIEF DESCRIPTION OF THE DRAWFNGS

FIG. 6 shows an example of the fixing control temperature set based on the count of the sheet counter;

FIG. 7 shows an example of the fixing control temperature set based on the count of the heater actuation time counter; and FIGS. 8A-8B illustrate the energy conservation rates corresponding to the preheat temperature and standby temperature.

DETAILED DESCRIPTION OF THE PREFERRED EMBODIMENTS

The embodiments of the present invention are described by way of specific examples hereinafter with reference to the drawings.

Figure 1:
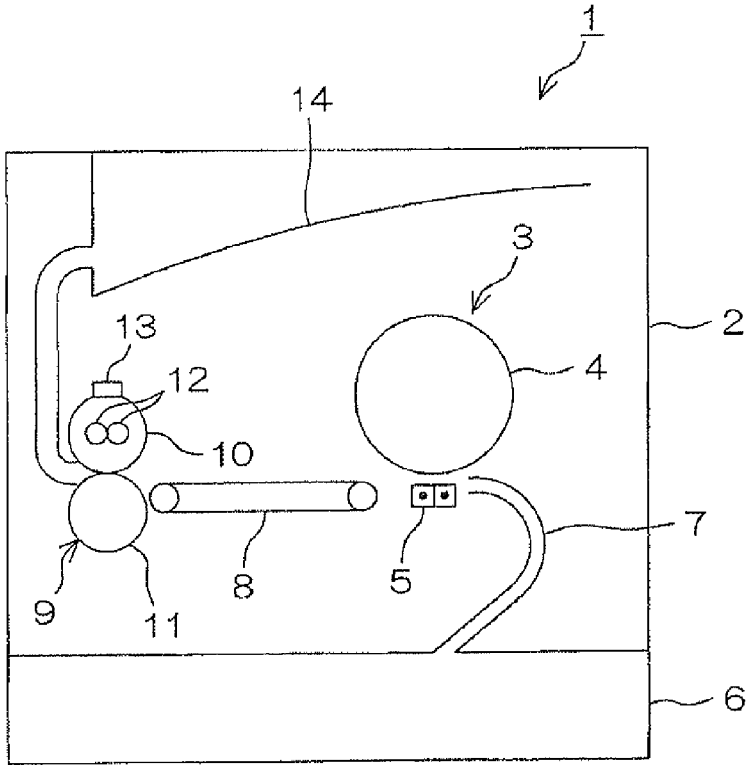
FIG. 1 is a brief cross section view showing the structure of the image forming device of an embodiment of the present invention.

FIG. 1 is a brief cross section view showing the structure of the image forming device 1 of an embodiment of the present invention.

Referring to FIG. 1, an image forming device 1 is, for example, a copying machine, capable of forming an image (copy) on a paper sheet based on document image data read by a scanner (not shown in the drawing).

The outward appearance of the image forming device 1 is divided by an approximately square shaped housing 2. An image forming unit 3, which forms an image by transferring a toner image to a sheet based on document image data read by a scanner, is arranged within the housing 2. The image forming unit 3 may use a well known configuration provided with a photosensitive body 4, and transfer device 5, as well as a developing device and main charger not shown in the drawing. That is, during image formation, the surface of the approximately cylindrical photosensitive body 4 is uniformly charged by the main charger, and a so-called electrostatic latent image is formed on the surface of the photosensitive body 4 by irradiating the surface of the photosensitive body 4 with light based on the image data. The developing device selective adhered toner to the surface of the photosensitive body 4 bearing the electrostatic latent image so as to form a toner image. Then, the toner image formed on the surface of the photosensitive body 4 is transferred onto a paper sheet by the operation of a transfer device.

A paper receiving unit 6, which accommodates the paper sheets used in image formation, is disposed at the bottom part of the housing 2. The sheet receiving unit 6 can accommodate paper sheets of different sizes (A3, B4, A4, B5, A5 and the like), and types (normal paper, OHP sheets, thin sheets and the like). During image formation, sheets accommodated in the sheet receiving unit 6 are fed one sheet at a time through a sheet transport path 7 to an image forming unit 4, and a toner image is transferred onto the sheet in the image forming unit 4.

The sheet bearing the transferred toner image is delivered to a fixing unit 9 by a conveyor belt 8. The fixing unit 9 fixes the transferred toner image onto the sheet, and is provided with a pair of fixing rollers (heating roller 10 and pressure roller 11) arranged so as to be rotatable. The heating roller 10 and pressure roller 11 abut one another such that the surfaces of the rollers are in mutual contact at a predetermined pressure, and at least one roller (for example, the heating roller 10) is heated by one or a plurality (for example, two) of fixing heaters 12 arranged within the heating roller 10. According to this configuration, a paper sheet bearing a transferred toner image is subjected to a fixing process, such as a heating process and pressure process and the like, as the sheet passes between the heating roller 10 and pressure roller 11, so as to fix the transferred toner image onto the sheet. Reference number 13 refers to a fixing thermistor for detecting the temperature of the heating roller 10 (roller surface). After image formation (after the fixing process), the sheet is discharged to a discharge tray 14 disposed outside the device.

Figure 2:
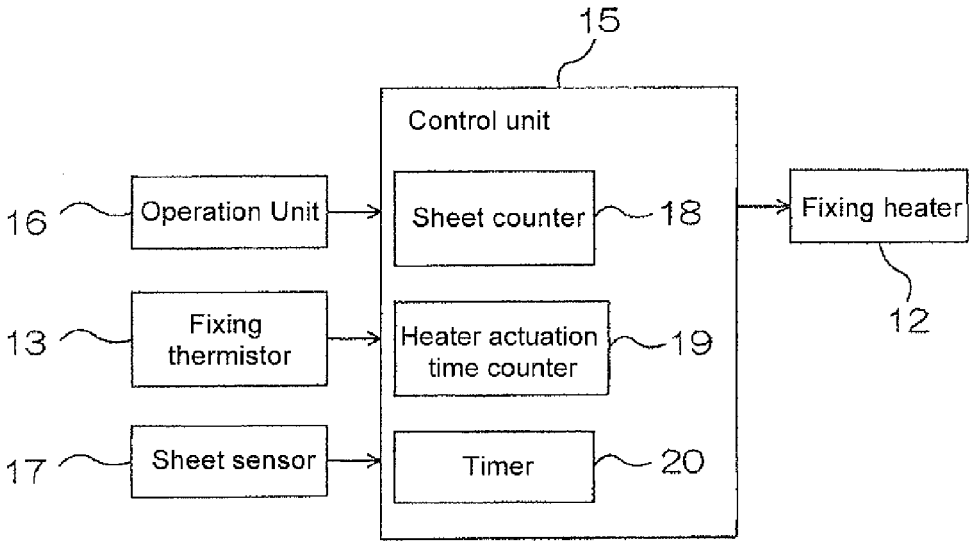
FIG. 2 is a block diagram showing the electrical structure of the image forming device.

FIG. 2 is a block diagram showing the electrical structure of the image forming device 1.

The operation of the image forming device 1 is controlled by a control unit 15, which includes a micro computer. The control unit 15 receives signals from the previously mentioned fixing thermistor 13 (signals representing the temperature of the heating roller 10), signals from an operation unit 16 used for various types of input operations (signals directing the start of an image forming operation and the like), and signals from a sheet sensor 17 for detecting whether or not a sheet has passed through the fixing unit 9 and the like. When a copy is made in the image forming device 1, the size and the type of the paper sheet to be used is input by operating the operation unit 16.

The fixing heater 12 is connected to the control unit 15 as a control object, and the control unit 15 adjusts the heating roller 10 to a predetermined temperature (fixing control temperature) by turning ON/OFF the actuation of the fixing heater 12 based on signals input from the fixing thermistor 13.

The control unit 15 is provided with a sheet counter 18 for counting (integrating) points corresponding to the number of sheets undergoing the fixing process performed by the fixing unit 9, heater actuation time counter 19 for counting (integrating) points corresponding to the actuation time (ON time) of the fixing heater 12 when the fixing process is performed by the fixing unit 9, and a timer 20 for counting time.

A large amount of heat is imparted to the sheets undergoing the fixing process performed by the fixing unit 9 when a relatively large number of sheets undergo the fixing process (heating process) performed by the fixing unit 9, and a small amount of heat is imparted to the sheets undergoing the fixing process performed by the fixing unit 9 when a relatively small number of sheets undergo the fixing process (heating process) is performed by the fixing unit 9. A large amount of heat is imparted to the sheets undergoing the fixing process performed by the fixing unit 9 when the fixing heater 12 has a relatively long actuation time while the fixing process (heating process) is performed by the fixing unit 9, and a small amount of heat is imparted to the sheets undergoing the fixing process performed by the fixing unit 9 when the fixing heater 12 has a relatively short actuation time while the fixing process (heating process) is performed by the fixing unit 9.

Accordingly, the points counted by the sheet counter 18 (points corresponding to the number of sheets subjected to the fixing process performed by the fixing unit 9), and the points counted by the heater actuation time counter 19 (points corresponding to the actuation time (ON time) of the fixing heater 12 while the fixing process is performed by the fixing unit 9) respectively represent the integration value of values corresponding to the amount of heat imparted to the sheets undergoing the fixing process performed by the fixing unit 9, that is, the integration value of values corresponding to the power consumed (by the fixing unit 9) during the image forming operation within a predetermined time.

Figure 3:
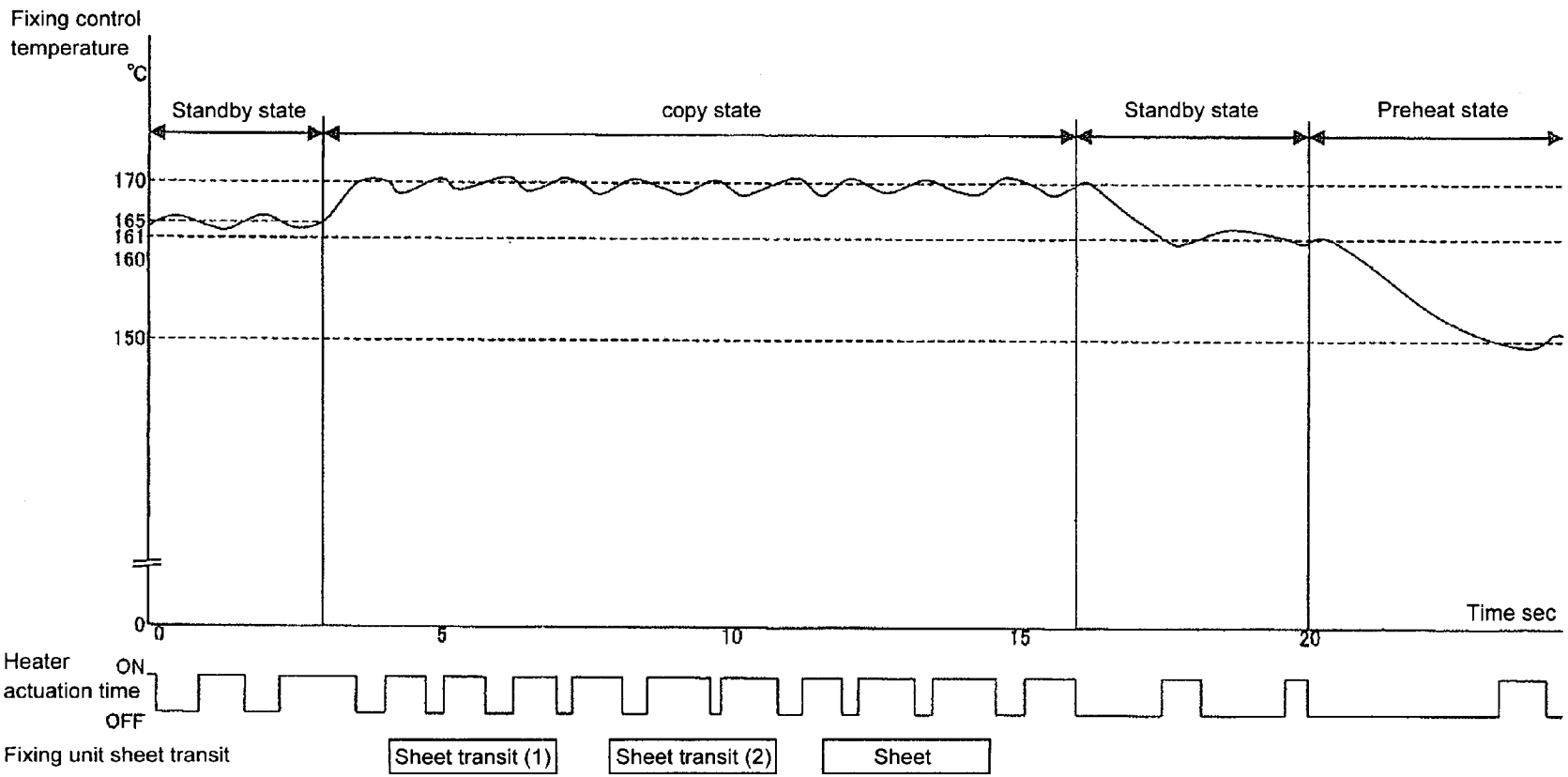
FIG. 3 is a time chart showing an example of the changing fixing control temperature.

FIG. 3 is a time chart showing an example of the changing fixing control temperature.

Referring to FIG. 3, the operating states of the image forming device 1 include, in addition to the image forming operation state, a standby state and preheat state as non-image forming operation states in which the image formation operation is not performed.

In the copy state, the fixing control temperature is set at a relatively high temperature (for example, 170° C.) in order to perform the heating process on a sheet after a toner image has been transferred by the image forming unit 3. During the copy state, the control unit 15 adjusts the ratio of the ON time relative to the OFF time of the fixing heater 12 based on input signals from the fixing thermistor 13, and feedback control is performed such that the temperature of the fixing heater 12 attains the set temperature (fixing temperature). The fixing temperature differs depending on the type of sheet used (normal paper, OHP sheet, thin sheet and the like), that is, the temperature is set higher than the temperature for normal paper when an OHP sheet is used, and the temperature is set lower than normal paper when a thin sheet is used.

When the image forming operation (copy state) ends, the fixing control temperature is set lower than the temperature of the copy state (for example, a predetermined temperature between 157~165° C.), and the operating state of the image forming device 1 becomes the standby state. During the standby state, the control unit 15 reduces the drive power supplied to the fixing heater 12 by reducing the ratio of the ON time relative to the OFF time of the fixing heater 12 to be lower than the ratio in the copy state, and feedback is performed such that the temperature fixing heater 12 attains the set temperature (standby temperature).

The fixing control temperature is set to a temperature lower than the standby state (for example, a predetermined temperature between 135~155° C.) when an image forming operation has not started after a fixed time has elapsed since the standby state was entered, and the operating state of the image forming device 1 becomes the preheat state. During the preheat state, the control unit 15 reduces the drive power supplied to the fixing heater 12 by reducing the ratio of the ON time relative to the OFF time of the fixing heater 12 to be lower than the ratio in the standby state, and feedback is performed such that the temperature fixing heater 12 attains the set temperature (preheat temperature).

In the example of FIG. 3, during the copy state the fixing process is performed on three sheets of paper at a fixing temperature of approximately 170° C. by starting the image forming operation in the standby state in which the fixing control temperature is set at 165° C., and changing the fixing control temperature to 170° C. When the image forming operation ends, the standby state is entered in which the fixing control temperature is set at 161° C., and transitions to the preheat state in which the fixing control temperature is set at 150° C. after a fixed time has elapsed since the start of the standby state.

Thus, during the non-image forming operation time (standby state and preheat state), the power consumption of the fixing unit (fixing heater 12) can be reduced by reducing the actuation power supplied to the fixing heater 12, and the temperature of the heating roller 10 can be raised in a short time when the image forming operation starts.

Figures 4, 5:
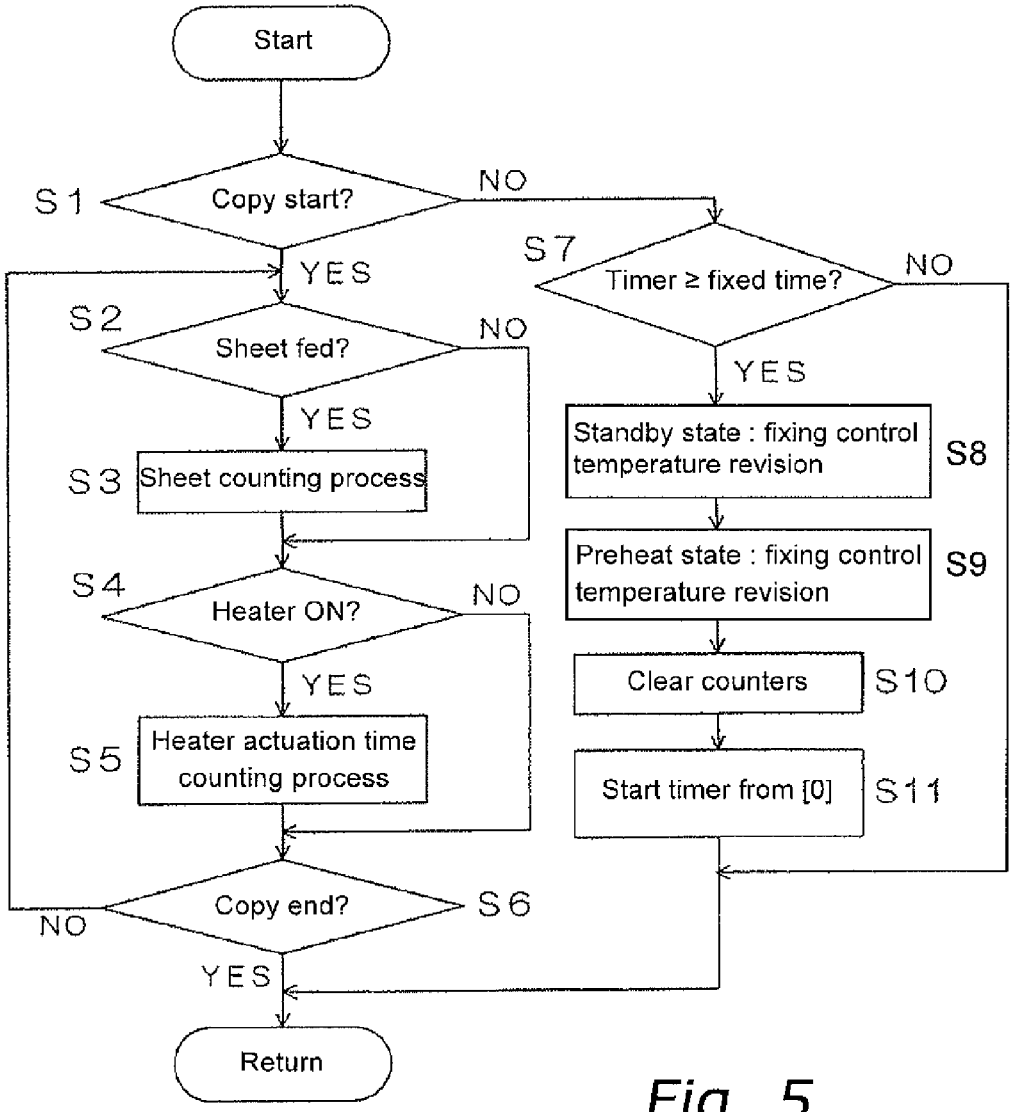
FIG. 4 illustrates the points counted in the sheet counter.
FIG. 5 is a flow chart showing the content of the controls performed by the control unit while power is turned ON to the image forming device.

FIG. 4 illustrates the points counted in the sheet counter.

As shown in FIG. 4, when the fixing unit 9 has performed the fixing operation on a particular sheet, the sheet counter 18 counts the points obtained by multiplying a coefficient corresponding to the sheet size (A3, B4, A4, B5, A5 and the like) corresponding the surface area of the sheet, and a coefficient corresponding to the type of sheet (normal paper, OHP sheet, thin sheet and the like).

More specifically, the A4 paper size is set as the standard size (coefficient: 1.0); B4 size has a surface ratio of 1.7 relative to the A4 size, and the associated B4 coefficient is 1.7; A3 size has a surface ratio of 2.0 relative to the A4 size, and the associated A3 coefficient is 2.0; B5 size has a surface ratio of 0.7 relative to the A4 size, and the associated A5 coefficient is 0.7; A5 size has a surface ratio of 0.5 relative to the A4 size, and the associated A5 coefficient is 0.5. Regarding types of paper, normal paper is set as the standard type (coefficient: 1.0); the OHP sheet has a weight ratio (or thickness) of 1.5 relative to normal paper, and the associated OHP coefficient is 1.5; the thin sheet (for example, tracing paper) has a weight ratio (or thickness) of 0.5 relative to normal paper, and the associated thin sheet coefficient is 0.5.

In the example shown in FIG. 4, the count value (integration value) of the sheet counter 18 becomes 2198 points by counting the points obtained by multiplying the coefficients corresponding to the type and size of the sheets as described above for a predetermined time period for example, one week. Although not shown in the drawing, the ON time (seconds) of the fixing heater 12 during the image forming operations (during the copy state) performed within a predetermined time period (for example, one week) is counted by the heater actuation time counter 19. Accordingly, when the ON time of the fixing heater 12 is 2831 seconds, for example, during the image forming operations (during the copy state) performed within the previously discussed predetermined time period, the count value (integration value) of the heater actuation time counter 19 becomes 2831 points.

In this embodiment, the fixing control temperature is set in the non-image forming operation time (standby state and preheat state) in accordance with the points counted by the sheet counter 18 during one week and the point counted by the heater actuation time counter 19 during one week, so as to control the power consumption (by the fixing unit 9) during the non-image forming operation time. According to this configuration, an increase in the power consumption of the entire image forming device 1 can be prevented by determining the power consumption (of the fixing unit 9) during the non-image forming operation time based on the points counted by the sheet counter 18 and the points counted by the heater actuation time counter 19, and reducing the power consumption (in the fixing unit 9) during the non-image forming operation time when power consumption is high.

A large amount of heat is imparted to the sheet subjected to the heating process performed by the fixing unit 9 when the sheet has a relatively large surface area (size), and a small amount of heat is imparted to the sheet subjected to the heating process performed by the fixing unit 9 when the sheet has a relatively small surface area (size). A large amount of heat is imparted to the sheet subjected to the heating process performed by the fixing unit 9 when the sheet is relatively thick (high weight ratio), and a small amount of heat is imparted to the sheet subjected to the heating process performed by the fixing unit 9 when the sheet is relatively thin (low weight ratio).

In this embodiment, since the points counted by the sheet counter 18 are values corresponding to the type and size (surface area) of the sheet subjected to the fixing process (heating process) performed by the fixing unit 9, the power consumption of the fixing unit 9 can be more accurately determined during the image forming operation time (during the copy state).

FIG. 5 is a flow chart showing the content of the controls performed by the control unit 15 while power is turned ON to the image forming device 1.

Referring to FIG. 5, when copying is started by the operation of the operation unit 16 (step S1: YES), the control unit 15 monitors whether or not the sheet has passed through the fixing unit 9 (step S2), and monitors whether or not the fixing heater 12 is actuated (step S4) based on input signals from the sheet sensor 17 until copying ends (until step S6: YES).

When the sheet has passed through the fixing unit 9 (step S2: YES), the control unit 15 counts, through the sheet counter 18, the points obtained by multiplying the coefficients corresponding to the type and size of the sheet based on the previously input sizes and types (step S3: sheet counting process). Furthermore, when the fixing heater 12 is actuated (step S4: YES), the control unit 15 counts, through the heater actuation time counter 19, the ON time of the fixing heater 12 (step S5: heater actuation time counting process). Then, when copying ends (step S6: YES), the control unit 15 monitors whether or not copying has been started by the operation of the operation unit 16 (step S1).

When copying is not being performed (step S1: NO), that is, during the non-image forming operation time, the control unit 15 monitors whether or not a fixed time period has elapsed (for example, one week) based on the input signals from the timer 20. Then, when the fixed time period has elapsed (step S7: YES), the control unit 15 sets (revises) the fixing control temperature in the standby state (step S8), and sets (revises) the fixing control temperature in the preheat state (step S9) based on the count value of the sheet counter 18 or the count value of the heater actuation time counter 19. Thereafter, the control unit 15 clears each count value of the sheet count 18 and heater actuation time counter 19 (step S10), starts count of the timer 20 from [0] (step S11), and again monitors whether or not copying has been started by operation of the operation unit 16 (step S1).

FIG. 6 shows an example of the fixing control temperature set based on the count of the sheet counter 18.

As shown in FIG. 6, the fixing control temperature in the standby state (standby temperature) is set at a lower temperature the higher the point count by the sheet counter 18 during a fixed time period (for example, one week).

In the present embodiment, the preheat state can be set so as to be executed by either an energy conservation priority mode, or recovery time priority mode by operating the operation unit 16 beforehand. In the recovery time priority mode, the temperature of the heating roller 10 can be raised to the fixing temperature (recovery) in a short time, even when the image forming operation has started in the preheat state, by setting the fixing control temperature in the preheat state (preheat temperature) at a fixed value (for example, 155° C.) regardless of the count value of the sheet counter 18. In the energy conservation priority mode, the preheat temperature can be set at a lower temperature the higher the point count of the sheet counter 18.

When the count value of the sheet counter 18 is 2198 points, as shown in FIG. 4, the standby temperature is set at 161° C., the preheat temperature is set at 145° C. in the energy conservation priority mode, and set at 155° C. in the recovery time priority mode.

FIG. 7 shows an example of the fixing control temperature set based on the count of the heater actuation time counter 19.

As shown in FIG. 7, the fixing control temperature in the standby state (standby temperature) is set at a lower temperature the higher the point count by the heater actuation time counter 19 during a fixed time period (for example, one week).

In the recovery time priority mode, the temperature of the heating roller 10 can be raised (recover) to the fixing temperature in a short time, even when an image forming operation has started in the preheat state, by setting the fixing control temperature in the preheat state (preheat temperature) at a fixed value regardless of the count value of the heater actuation time counter 19. In the energy conservation priority mode, the preheat temperature may be set at a lower temperature the higher the point count of the heater actuation time counter 19.

When the count value of the heater actuation time counter 19 is, for example, 2831 points, the standby temperature is set at 163° C., the preheat temperature is set at 150° C. in the energy conservation priority mode, and set at 155° in the recovery time priority mode.

FIGS. 8A-8B illustrate the energy conservation rates corresponding to the preheat temperature and standby temperature. FIG. 8A shows the energy conservation ratio and ratio of ON time relative to OFF time of the fixing heater 12 in the preheat state according to the preheat temperature; FIG. 8B shows the energy conservation ratio and ratio of ON time relative to OFF time of the fixing heater 12 in the standby state according to the standby temperature.

As shown in FIG. 8A, when the preheat temperature is set low, power consumption is low and energy conservation increases since the ratio of the ON time relative to the OFF time of the heating roller 12 is small in the preheat mode. As shown in FIG. 8B, when the standby temperature is set low, power consumption is low and energy conservation increases since the ratio of the ON time relative to the OFF time of the heating roller 12 is small in the standby mode.

The present invention is not limited to the content of the above embodiments, and may be variously modified within the scope of the claims.

For example, when power consumption is high in the image forming operation (during the copy state), the configuration is not limited to controllably reducing the power consumption of the fixing unit 9 (fixing heater 12), and may be configured so as to controllably reduce a part of the power consumption other than that of the fixing unit 9.

Furthermore, the present invention is not limited to copy machines, inasmuch as it is also applicable to image forming device other than copy machines, such as printers and facsimile machines and the like.

The invention claimed is:

1. An image forming device capable of forming an image on paper by transferring a toner image onto the paper, and fixing the transferred toner image onto the paper by means of a heating process performed by a fixing unit, the image forming device comprising:

an integrating means for integrating values corresponding to the power consumed during an image forming operation; and a power consumption control means for controlling the power consumption at times other than during the image formation processing in accordance with the values integrated by the integrating means within a predetermined time period, the power consumption control means for lowering the power consumption when the values integrated by the integrating means increase.

2. The image forming device of claim 1, wherein the integrating means integrates values corresponding to the amount of heat imparted to a sheet when a heating process is performed by the fixing unit, and the power consumption control means controls the power consumption of the fixing unit at times other than during the image formation process in accordance with the values integrated by the integrating means within the predetermined time period.

3. The image forming device of claim 2, wherein the integrating means comprises number of sheets integrating means for integrating values corresponding to the number of sheets used in the heating process performed by the fixing unit.

4. The image forming apparatus of claim 3 further comprising, a means for changing the value integrated by the number of sheets integrating means in accordance with a surface area of the sheet subjected to the heating process performed by the fixing unit.

5. The image forming apparatus of claim 3 further comprising, a means for changing the value integrated by the number of sheets integrating means in accordance with type of the sheet subjected to the heating process performed by the fixing unit.

6. The image forming apparatus of claim 2, wherein the fixing unit comprises a heater actuated for a heating process, and the integrating means comprises a heater actuation time integrating means for integrating values corresponding to the heater actuation time when a heating process is performed by the fixing unit.

7. The image forming device of claim 6, wherein the integrating means further includes number of sheets integrating means for integrating values corresponding to the number of sheets used in the heating process performed by the fixing unit.

* * * * *